US005122106A

United States Patent [19]

Atwood et al.

[11] Patent Number: 5,122,106

[45] Date of Patent: Jun. 16, 1992

[54] STRETCHING APPARATUS

[75] Inventors: Duncan F. Atwood, 1237 N.E. 170th, Seattle, Wash. 98155; Joseph Stefanile, Issaquah, Wash.

[73] Assignee: Duncan F. Atwood, Seattle, Wash.

[21] Appl. No.: 582,713

[22] Filed: Sep. 13, 1990

Related U.S. Application Data

[63] Continuation-in-part of Ser. No. 260,809, Oct. 20, 1988, abandoned.

[51] Int. Cl.[5] ..... A63B 21/00

[52] U.S. Cl. ..... 482/131; 128/25 R; 128/25 B; 482/907; 482/80; 482/134; 482/137

[58] Field of Search ..... 272/96, 130, 134, 143, 272/145, 126, 900, 902, 903, 71; 128/25 R, 25 B, 26, 87 R, 85, 86, 88, 80 R, 70, 74; 73/379

[56] References Cited

U.S. PATENT DOCUMENTS

| | | | |
|---|---|---|---|
| 26,725 | 11/1969 | Sellner . | |
| 2,598,204 | 5/1952 | Allen | 272/130 X |
| 2,644,688 | 7/1953 | Roberge . | |
| 2,764,412 | 9/1956 | Dunham . | |
| 3,020,046 | 2/1962 | Hotas | 272/96 |
| 3,791,646 | 2/1974 | Marchignoni | 272/71 |
| 3,834,694 | 9/1974 | Prigden . | |
| 3,975,051 | 8/1976 | Ballagh | 128/25 R X |
| 3,984,101 | 10/1976 | Garza | 272/126 |
| 4,089,330 | 5/1978 | Nicolosi et al. | 128/25 R |
| 4,207,879 | 6/1980 | Safadago et al. | 272/903 |
| 4,323,000 | 4/1982 | Pecheux | 128/25 R X |
| 4,456,247 | 6/1984 | Ehrenfried | 272/126 |
| 4,474,176 | 10/1984 | Farris et al. | 128/25 B |
| 4,566,440 | 1/1986 | Berner et al. | 128/25 R |
| 4,647,040 | 3/1987 | Ehrenfried | 272/126 |
| 4,650,183 | 3/1987 | McIntyre | 128/25 BX |
| 4,665,899 | 5/1987 | Farris et al. | 128/25 R |
| 4,669,450 | 6/1987 | Lindberg | 128/25 B |
| 4,671,257 | 6/1987 | Kaiser | 128/25 R |
| 4,738,269 | 4/1988 | Nashner | 434/258 X |
| 4,825,852 | 5/1989 | Genovese et al. | 128/25 R |
| 4,892,304 | 1/1990 | DeNiro | 272/126 |
| 4,986,261 | 1/1991 | Iams et al. | 128/25 R |

FOREIGN PATENT DOCUMENTS

| | | | |
|---|---|---|---|
| 540837 | 7/1922 | France . | |
| 0022002 | 1/1981 | France | 128/25 R |

OTHER PUBLICATIONS

Shape, Apr. 1987, p. 40, "Stretch to Fitness" by Kerlan and Mackenzie.

*Primary Examiner*—Robert Bahr
*Assistant Examiner*—Linda C. M. Dvorak
*Attorney, Agent, or Firm*—Christensen, O'Connor, Johnson & Kindness

[57] ABSTRACT

A stretching apparatus (10) includes a base structure (12) for supporting an individual in supine position. One leg of the individual is disposed within a cradle (14) pivotally mounted on the base structure (12) by a pair of arm assemblies (16a, 16b) which are powered by a hydraulic actuator (20) to rotate about an axis (22) extending generally transversely to the individual's body at a location coinciding with the hip joints of the individual. The cradle (14) includes a foot cup (18) for receiving and supporting the rear and side portions of the individual's foot through which a stretching load is applied to the individual's leg for stretching the muscles, tendons and joint capsules of the lower back, hip, leg, and foot.

19 Claims, 5 Drawing Sheets

STRETCHING APPARATUS

CROSS-REFERENCE TO RELATED APPLICATION

The present application is a continuation-in-part of U.S. patent application Ser. No. 260,809, filed Oct. 20, 1988, now abandoned.

TECHNICAL FIELD

The present invention relates to a body stretching apparatus, and more particularly to an apparatus for stretching the muscles, tendons and joint capsules associated with the limbs of the body, for instance, the muscles, tendons and joint capsules of the hip, thigh, calf, and foot in a safe, controlled, and repeatable manner.

BACKGROUND OF THE INVENTION

In recent years, regular physical exercise has become a permanent part of the life of millions of Americans and this trend is continuing. With the advent of greater emphasis in physical fitness and exercise there has been a dramatic rise in musculoskeletal injuries, especially to the muscles of the hips, legs, and ankles. One reason for such injuries is the failure to recognize the importance of stretching the body muscles prior to and after exercising. Regular stretching of the body muscles increases both the flexibility and the range of motion of the muscles. Stretching also reduces a likelihood of injury by preparing the muscles, ligaments, and tendons for the stress of exercise.

Realizing the importance of stretching the muscles is not enough. The muscles must be stretched properly to avoid injury during the stretching exercise itself. To avoid overtaxing the muscles, gradual, static stretches should be used rather than dynamic, bouncing-type stretches. Moreover, the ideal way to stretch muscles is while the muscles are in a relaxed state, thereby maximizing the range of motion of the muscle while minimizing the likelihood of a muscle pull or other injury.

However, it is difficult for an individual to apply gradual, static stretch to muscles, especially the larger muscles of the legs, for example, the hamstring muscles. One common manner of stretching the hamstring muscles is to lie in a supine position with the leg to be stretched raised up in the air and the other leg on the ground/floor. Then, either the exerciser himself pulls the raised leg forwardly toward his head by grasping the back of his thigh with his hands or a second individual positioned in front of the exerciser pushes against the raised leg. As can be appreciated, it is difficult for either the exerciser or his assistant to apply a steady, safe load on the leg. Moreover, it is not possible to accurately apply the same force against the leg each time the hamstring muscles are stretched, thus the extent to which the muscles are stretched can vary considerably from day-to-day or time-to-time.

Various apparatus have been developed for stretching the leg muscles. One such type of apparatus utilizes a harness or strap to engage around the lower leg or foot of the exerciser while in a supine position. A cord attached to the strap is pulled by the individual to rotate the leg about the hip joint in the direction toward the individual's head. Examples of such exercise apparatus are disclosed by U.S. Pat. No. 3,834,694 and 4,456,249. One drawback of this type of exercise apparatus is that it is not possible to accurately apply small incremental loads to the leg. Further, such devices constantly apply a force to the leg rather than holding the leg in a desired orientation. As a result, the leg is not able to be relaxed and thus does not reach its maximum range of motion. It is known that after a muscle is stretched to or near its maximum level for a period of time, if a maximum contraction of the muscle is made and the muscle is then allowed to relax, the proprioceptive neuromuscular facilitation phenomenon occurs whereby a dip in the muscle stretch reflex occurs so that the muscle can be stretched somewhat further. Moreover, with such devices disclosed in the '694 and '249 patents, it is difficult if not impossible to stretch the leg through a quantifiable range of motion so that the individual can repeatedly apply the same level of stretch to a desired muscle.

In another type of apparatus, a motorized swing arm is strapped to the lower leg or lower arm to move the distal section of the limb through a range of motion about the knee or elbow joint, thereby to provide physical therapy to increase the range of motion in an elbow or knee joint that has reduced mobility. An example of this type of device is disclosed by U.S. Pat. No. 4,089,330. One drawback of this particular type of device is that it is large, cumbersome and too expensive for individuals to purchase for home use. Moreover, this type of device also places a constant load on the body limb rather than simply holding the leg in the desired position, thereby removing the possibility and fear of overstretching while in this stable position, and thus allowing the user to relax.

SUMMARY OF THE INVENTION

The above-discussed and other limitations of prior art apparatus ostensibly designed to stretch the body muscles are addressed by the present invention which provides an apparatus for stretching the body muscles, including the muscles, tendons and joint capsules of the lower back, hip, thigh, calf, and foot in a safe, controlled, repeatable and quantifiable manner. Hereinafter, the term "muscles" shall also include associated tendons and joint capsules. The stretching apparatus includes a cradle for receiving a limb of the user. The cradle is mounted to pivot about an axis extending generally transversely of the length of the user's limb and approximately through the pivot joint of the user's limb, thereby to stretch and flex the user's limb about such pivot joint. In the apparatus of the present invention, the cradle may be maintained at a desired angular position about the pivot axis of the cradle without tending to further pivot the body limb, thereby permitting the muscles being stretched to relax after contracting so that the proprioceptive neuromuscular facilitation phenomena can be employed to further stretch the muscles once the muscle stretch reflex has been reduced.

In another aspect of the present invention, the extent to which a muscle is stretched is quantified. For instance, the angular position of the cradle and, thus, also the range of movement of the limb associated with the muscle being stretched, is given with a numerical value or other scale. In addition or as an alternative, the stretching load being applied to the limb is measured so that this load can be monitored to prevent applying too large of a load on the limb which could cause physical damage thereto. This enables the present invention to be utilized in conjunction with a safe, controllable stretching regime to progressively stretch desired muscles of the body.

In one illustrative but not limiting example of the present invention, the cradle is adapted to receive the upwardly extending leg or foot of the user who is disposed in supine position. The pivot axis of the cradle extends approximately through the hip joints of the user, thereby to stretch and flex the user's leg about the hip joint. Further, the cradle may be maintained at a desired angular position about the hip pivot axis of the cradle.

In a more particular aspect of the present invention, the leg cradle includes a foot cup for receiving and supporting at least the back and sides of the user's foot. The cradle is designed so that the distance between the foot cup and the hip pivot axis of the cradle may be varied to accommodate legs of different lengths.

In another aspect of the present invention, the foot cup is mounted on the cradle to permit the foot cup to pivot about an axis extending transversely to the foot approximately through the user's ankle joint. This permits the present invention to be utilized to stretch and flex the muscles of the calf, ankle, foot, and toe regions.

In an additional aspect of the present invention, the foot cup is mounted on the cradle to pivot about an axis extending longitudinally of the foot cup. This allows the present invention to be employed to stretch and flex the everter and inverter muscles of the calf, ankle and foot.

In a further aspect of the present invention, the cradle includes a pair of arm assemblies that are pivotally mounted at the hip pivot axis of the cradle. Power means controlled by the exerciser operates on at least one of the pivot arm assemblies to move the pivot leg, and thus the cradle, about the hip pivot axis of the cradle thereby to place a stretching load on the leg disposed in the cradle. In a specific aspect of the present invention, the power means include an actuator manually operable by the exerciser. The actuator not only rotates the cradle about the hip pivot axis, but also maintains the cradle stationary at a desired orientation relative to the hip pivot axis and/or at a position that applies a desired stretching load on the leg.

BRIEF DESCRIPTION OF THE DRAWINGS

The details of a typical, but not limiting, embodiment of the present invention will be described in connection with the accompanying drawings in which.

DETAILED DESCRIPTION OF THE PREFERRED EMBODIMENTS

Figure 1:
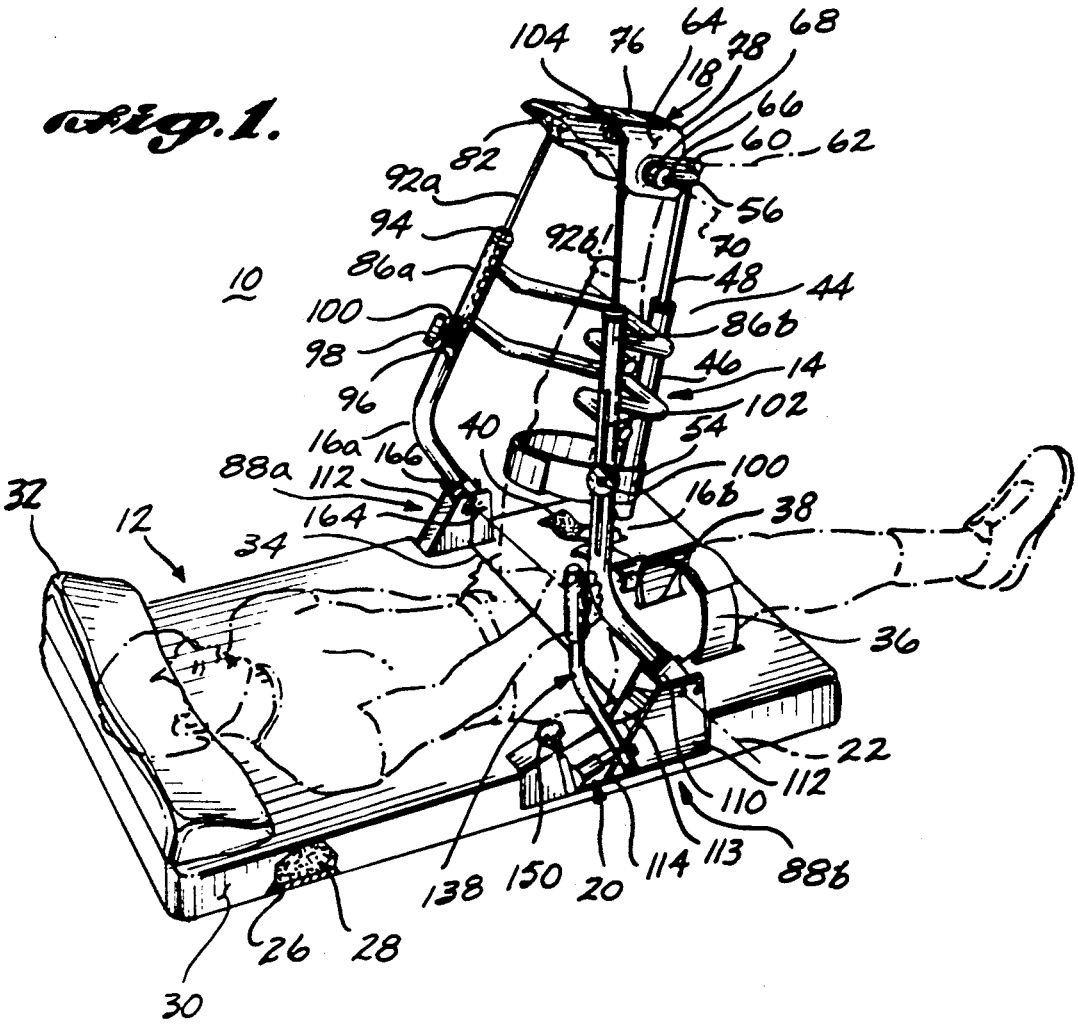
FIG. 1 is an isometric view of a stretching apparatus of the present invention.

Referring initially to FIG. 1, the stretching apparatus 10 of the present invention is illustrated as being utilized by an individual disposed in a supine position. The apparatus 10 includes a base structure 12 for supporting the head, torso, and the upper section of a stationary leg of the individual. The leg being stretched is disposed within a cradle 14 pivotally mounted on the base structure 12 by a pair of arm assemblies **16*a* and 16*b*. The cradle 14 includes a foot cup 18 for receiving and supporting the rear and side portions of the individual's foot. A power device in the form of a hydraulic actuator 20 is manually operated by the individual to pivot the leg assemblies 16*a* and 16*b* together with the cradle 14 about an axis 22** extending transversely across the individual's body at a location coinciding or nearly coinciding with the hip joints of the individual.

The following shall describe the above-mentioned components in greater detail. In such description, the term "forward" shall refer to the direction toward the individual's head, i.e., left-hand direction shown in FIGS. 1 and 2. Conversely, the "rearward" direction shall refer to the right-hand direction shown in FIGS. 1 and 2. Also, the "upward" direction shall refer to the direction toward the foot cup 18 shown in FIGS. 1 and 2 whereas the "downward" direction shall refer to the direction toward the base structure 12. Further, the "inward" direction shall refer to the direction toward the longitudinal center of the apparatus whereas the "outward" direction shall refer to the direction towards the longitudinal outside edges of the base structure 12.

Figure 3:
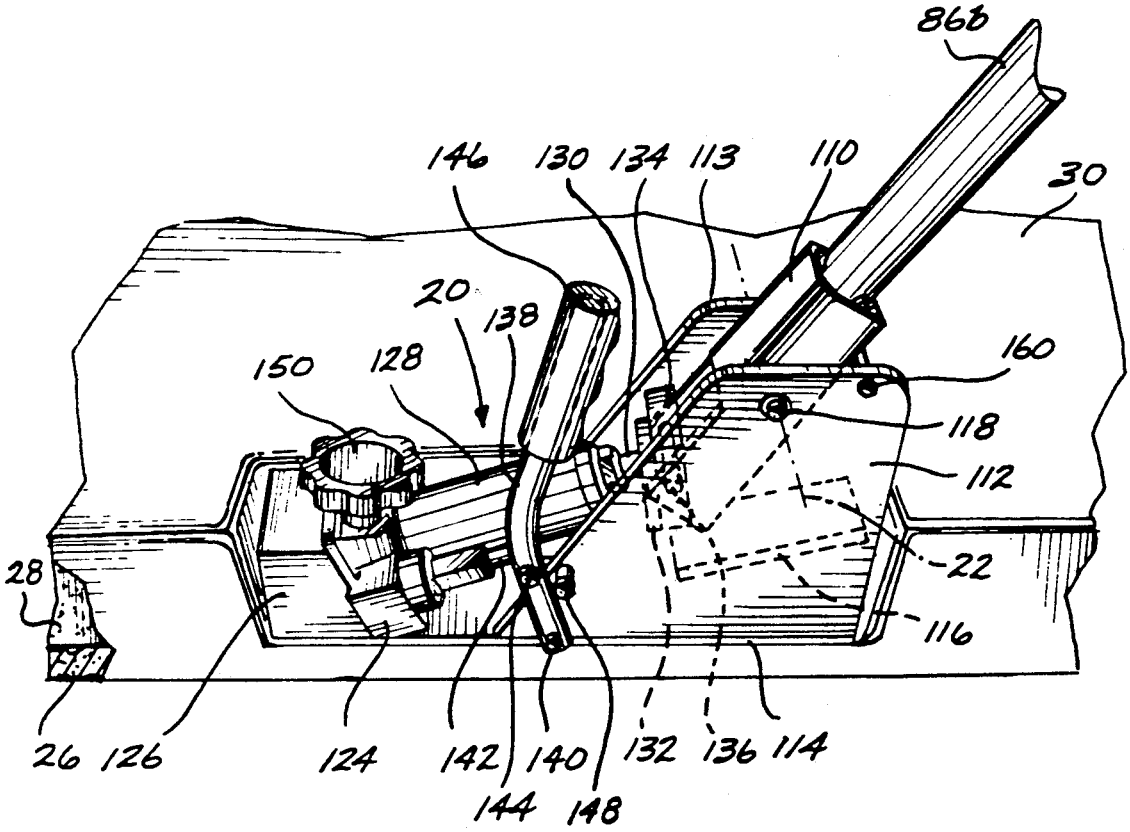
FIG. 3 is an enlarged, fragmentary, isometric view of the apparatus shown in FIGS. 1 and 2, specifically illustrating the manner in which the apparatus is powered.

The base structure 12 as shown in FIGS. 1 and 3, includes an underlying, flat, rectangularly shaped base plate 26 and an overlying layer of padding 28 shaped to correspond to the base plate. The padding may be composed of any appropriate material, such as rubber or foamed rubber, thereby to provide comfort to the individual. A cover 30 extends over the top and sides of padding 28 and also extends downwardly to cover the sides of the base plate 26. The cover may be composed of any appropriate material which preferably is tough enough to withstand rugged use of the apparatus 10 and also resistant to liquids, such as perspiration. Examples of such materials include coated nylon, vinyls, and neoprene. For the comfort of the user, preferably, but not essentially, a padded pillow 32 is positioned at the head of the base structure 12. The pillow can be permanently mounted on the base structure or can be movable to facilitate replacement and accommodate users of different body sizes.

Ideally, the base structure 12 is constructed of a width which is sufficient to enable the user to position a desired leg in cradle 14, with the torso positioned between the cradle and the adjacent side of the base structure. Preferably, a positioning line 34 extends across the base structure at a location corresponding to the hip pivot axis 22 for use by the individual to properly position his body so that his hip joints are positioned in alignment with the pivot axis 22. Also, preferably, a strap assembly 36 extends across a portion of the right side of the base structure 12 and over the stationary leg of the individual to restrain the stationary leg from moving during the stretching of the opposite leg. The strap assembly may extend underneath the corresponding portion of the base structure and up through spaced-apart openings 38 formed in the base structure. The ends of the strap assembly may be detachably fastened together by any convenient means, such as by utilizing Velcro® or a buckle or other type of clasp, as is well known in the art. A second strap assembly 40, shown in open position, is provided for securing the opposite leg of the individual when the stationary leg shown in FIG.

1 is being stretched whereupon the individual is positioned on the opposite side of the base structure from the location shown in FIG. 1. Strap assembly 40 likewise extends beneath the corresponding portion of the base structure and up through spaced-apart openings formed in the base structure.

Although the base structure 12 is illustrated in FIG. 1 as being rectangular in shape, it will be appreciated that the base structure may be formed in other shapes without departing from the spirit or scope of the present invention. Moreover, the arm assemblies 16*a* and 16*b* may be affixed directly to a floor thereby eliminating the need for the base structure 12. Further, the base structure may be mounted on legs, not shown, to be supported above the floor level to facilitate entry onto and exit from the stretching apparatus 10.

Figure 2:
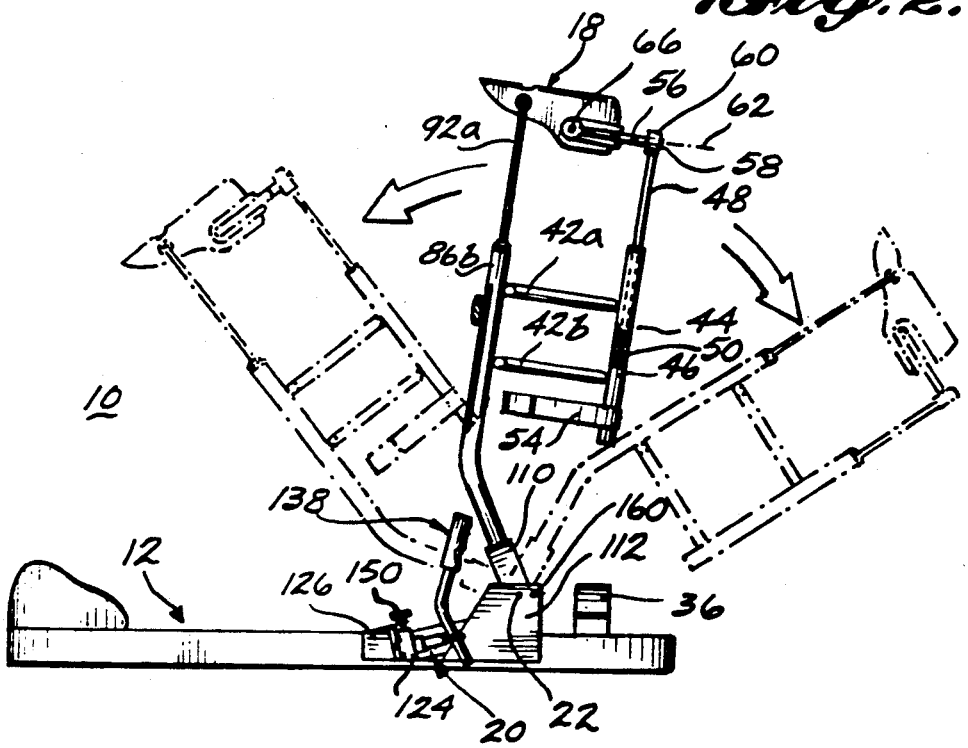
FIG. 2 is a side elevational view of the apparatus shown in FIG. 1.

As illustrated in FIGS. 1 and 2, the leg cradle 14 is composed of a pair of spaced apart, formed tubes 42*a* and 42*b* having a center section extending across the rear of the leg being stretched, side sections extending in the forward direction and end sections extending transversely outwardly to intersect with the arm assemblies 16*a* and 16*b*. The formed tubes 42*a* and 42*b* are fixedly mounted on the arm assemblies. It will be appreciated that the formed tubes 42*a* and 42*b* may be constructed from other types of material, such as rod, bar or strap stock without departing from the spirit or scope of the present invention.

The formed tubes 42*a* and 42*b* support a telescoping rear tube assembly 44 having an outer cylinder 46 affixed to and carried by the central portions of the formed tubes. The tube assembly 44 also includes an extendable rod 48 that is slidably receivable within the cylinder 46. The rod 48 is slightly biased in retracted position (downward) relative to the cylinder 46 by an internal extension spring 50 connected to and pulling downwardly on the lower end of the rod. This enables the cradle 14 to conveniently accommodate legs of different lengths by allowing the foot cup 18 to be raised to the appropriate height by simply placing the foot within the foot cup and straightening the leg.

As shown in FIG. 1, preferably the tube assembly 44 is long enough to extend downwardly at least partially along the thigh of the user. A thigh strap 54 is fastened to the distal portion of the cylinder 46 (the lower end of the cylinder as shown in FIG. 1) thereby to maintain the encircled portion of the thigh stationary relative to the tube assembly 44. Preferably, the thigh strap 54 may be circumferentially adjustable to accommodate different size legs and to vary the tightness and looseness of the strap about the user's thigh, which affects the extent to which the leg is allowed to be nominally bent as it is stretched. With different angles of bend of the leg about the knee, different sections of the leg muscles, for instance the hamstring muscles, are stretched by use of the apparatus 10.

Cradle 14 also includes a tubular yoke 56 employed to pivotally attach the foot cup 18 to the upper end of the cradle. The transverse central section of the yoke 56 is pivotally connected to the upper end of the rod 48 by a stub shaft 58 extending transversely rearwardly from the central portion of the yoke 56 and through a collar 60 fixed to the upper end of the rod 48. By this construction yoke 56 and, thus, also the foot cup 18 is adapted to pivot about an axis 62 extending longitudinally and centrally through the foot cup. The forward ends of yoke 56 are pivotally attached to the sidewalls 64 of the foot cup 18 by a stub shafts 66 extending transversely outwardly from the foot cup sidewalls 64 and through central openings formed in bosses 68 positioned at the forward ends of the yoke 56. It will be appreciated that by this construction the foot cup 18 may be pivoted about the axis 70 defined by the stub shaft 66, which axis ideally coincides with the ankle of the user. Moreover, it will be appreciated that by the foregoing construction, the yoke 56 functions as a gimbal enabling the foot cup 18 to be simultaneously pivoted about axes 62 and 70.

The foot cup 18 includes a substantially flat sole plate portion 76, a curved back wall 78 for overlapping and supporting the back of the foot of the user, and sidewalls 64 forming a continuation of the back wall to extend forwardly from the back wall to past the location of the ankle and then tapering towards the sole plate portion 76 to intersect with the front of the sole plate portion. Ideally, for economy of production, the foot cup 18 is molded as a singular unit from any appropriate material, such as a high-strength plastic. However, it is to be understood that the foot cup need not be constructed as a unitary member, but may be fabricated from individual components without departing from the spirit or scope of the present invention. Also, ideally, an inner liner 82 is disposed within the foot cup 18 to provide comfort for the foot of the user and traction between the foot and the foot cup. It is to be understood that the shape and thickness of the liner 82 may be varied to accommodate feet of different sizes and also to position the feet within the foot cup so that the ankle of the user is substantially in alignment with axis 70. To this end, the liner may be readily removable from the foot cup 18. The liner 82 may be composed of any appropriate material, such as an open or closed cell foam.

Rather than including the sidewalls 64 and the back wall 78, it is to be understood that the foot cup 18 can be formed with simply the sole plate portion. In this instance, the stub shafts 66 of yoke 56 may be pivotally attached to the side edges of the sole plate portion. Also, in this instance, the inner liner 82 serves to improve traction between the foot and the sole plate.

As noted above, arm assemblies 16*a* and 16*b* serve to pivotally mount cradle 14 on the base structure 12. The arm assemblies also function to position the foot cup 18 at a desired angular orientation about the ankle axis 70. The arm assemblies include formed outer tubes 86*a* and 86*b* having their lower ends pivotally mounted on the side portions of the base structure 12 by mounting structures 88*a* and 88*b*, respectively. The outer tubes 86*a* and 86*b* are "dog-legged" shaped with the portions of the outer tubes located above the bend of the tubes extending toward the corresponding sidewalls 64 of the foot cup 18 along a straight line. As shown in FIG. 2, the upper sections of the outer tubes 86*a* and 86*b* are substantially parallel to tube assembly 44, whereas when viewed from the front or rear of the base structure 12, the upper sections of the outer tubes extend centrally inwardly in the upward direction. By this shape, the outer tubes 86*a* and 86*b* together with the formed tubes 42*a* and 42*b* of the cradle serve to position the foot cup 18 in an anatomically correct position relative to cradle axis 22 which, as discussed above, coincides, or nearly so, with the hip joints of the user.

The arm assemblies 16*a* and 16*b* also include extendable rods 92*a* and 92*b* extending outwardly from the upper ends (as viewed in FIGS. 1 and 2) of the outer tubes 86*a* and 86*b*. The rods 92*a* and 92*b* are guided within respective outer tubes 86*a* and 86*b* by apertured end caps 94 engaged with the upper ends of the outer tubes and internal pistons 96 disposed within the interior of the outer tubes and fixed to the lower ends of the rods. The rods 92a and 92b may be allowed to freely extend and contract relative to the outer tubes during particular stretching exercises wherein the foot cup 18 is pivoted about longitudinal axis 62 and/or ankle axis 70. Alternatively, the position of the rods 92a and 92b relative to their corresponding outer tubes 86a and 86b, may be fixed by the tightening of knobs 98 which are threadably engaged over stub shafts 100 extending outwardly from the outer circumference of pistons 96 and through elongate slots 102 extending along a substantial length of the outer tubes. When tightened on the stub shafts 100, the knobs 98 bear against the outer circumference of the outer tubes 86a and 86b. At their upper ends, the rods 92a and 92b are connected to the sidewalls 64 of the foot cup 18 by spherical connectors 104 which allow relative angular movement between the upper ends of the rods and the foot cup to accommodate, for instance, changes in the elevation of the foot cup and also movement of the foot cup about longitudinal axis 62 and/or transverse ankle axis 70.

The lower ends of the arm assemblies 16a and 16b are pivotally connected to the side portions of the base structure 12 by mounting structures 88a and 88b, respectively. Rectangularly shaped sleeves 110 are secured to the lower ends of the outer tubes 86a and 86b to be closely received between an outer cheek plate 112 and an inner cheek plate 113 disposed in spaced parallel relationship to each other. The cheek plates are generally triangular in shape to taper as they extend upwardly from a base plate 114. The base plate 114 overlies and is securely attached to the underlying portion of the base plate 26 of the base structure 12. As shown in FIG. 3, a cross plate 116 extends transversely between the cheek plates 112 at an elevation above the base plate 114 to reinforce the mounting structures 88a and 88b. Pivot shafts 118, aligned with axis 22, extend transversely between the cheek plates 112 to extend through aligned openings formed in the upper portions of the cheek plates and through transverse openings formed in the rectangular sleeves 110 thereby to pivotally mount the lower ends of the outer tubes 86a and 86b to the mounting structures 88a and 88b.

A hydraulic linear actuator 20 is utilized to rotate arm assemblies 16a and 16b and, thus, the cradle 14 in the counterclockwise direction as shown in FIGS. 1 and 2. In one preferred embodiment of the present invention, the actuator 20 is in the form of a hydraulic jack having a base portion 124 mounted on the sloped side face of a mounting block 126 secured to the base plate 114. The hydraulic jack 20 includes a cylinder portion 128 extending from the base 124 rearwardly and upwardly along the side of the base structure 12 towards the lower end of the rectangular sleeve 110 of the leg assembly arm. The jack 20 also includes an extendable piston rod 130 having a rectangularly shaped push block 132 attached to the forward end of the piston rod to bear against a reaction block 134 pivotally mounted between the sidewalls of the rectangular sleeve 110 by a cross shaft 136. As illustrated in FIG. 3, in the region of the reaction block 134, the wall of the tubular sleeve 110 facing the jack 20 has been removed to provide clearance for the reaction block. Since jack 20 is in fixed orientation, the angular relationship of the piston rod 130 of the jack and the sleeve 110 of the leg assembly 86b changes as the leg assembly is pivoted about axis 22 by extension and retraction of the piston rod and, thus, the pivoting reaction block 134 is employed to accommodate this change in relative angle.

To extend the piston rod 130, the pump of the jack 20 is operated by a manually graspable handle 138 pivotally mounted at its lower end to the outward side of the cheek plate 112 associated with leg assembly 16b by a pin 140 cantilevered outwardly from the cheek plate to extend through a transverse hole formed in the handle. The plunger 142 of the pump portion of the jack 20 is pinned to an intermediate section of the handle 138 by a cross pin 144. A grip 146 is engaged over the upper end of the handle 138 for convenient grasping by the apparatus user. A stop pin 148 extends transversely outwardly from the outer cheek plate 112 to limit the swing of handle 138 in the clockwise direction shown in FIGS. 1-3 thereby correspondingly limiting the throw of the jack plunger and, thus, also limiting the extension of the piston rod 130 with a particular stroke of the handle 138.

It will be appreciated that the jack 20 may be used to pivot the cradle 14 in the counterclockwise direction to stretch muscles of the leg; however, once the desired level of stretch has been achieved, the cradle is maintained in a stationary orientation relative to the pivot axis 22 so that a load is not being applied to the leg, attempting to further stretch the leg muscles. This enables the leg to be first maximally contracted and then relaxed to experience the proprioceptive neuromuscular facilitation phenomenon. The necessary relaxing of the stretched muscle would not be possible if the actuator 20 tended to cause the cradle 14 to continue to impart a load on the leg when the leg is in stretched condition.

The piston rod 130 is retracted by relieving the pressure within the cylinder 128 by switching of a valve, not shown, built into the base 124 of the jack 20 by rotation of a knob 150 located on the base 124 into "open" position. With the retraction of the piston rod 130, the cradle 14 is allowed to pivot in a clockwise direction, shown in FIGS. 1-3, thereby relieving the stretching load placed on the leg of the apparatus user. By controlling the extent to which knob 150 is rotated into open position, the present invention may advantageously be utilized to conduct isokinetic exercises by using the leg muscles to pivot the cradle at a substantially constant speed. Although not essential, a stop may be employed to limit the clockwise rotation of the leg assemblies 16a and 16b and thus also cradle 14. The stop may take the form of a cross shaft 160 spanning between the upper, rearward portions of the cheek plates 112 and 113 to bear against the adjacent surface of the rectangular sleeve 110 of outer tube 86b, see FIG. 3.

It is to be understood that while the actuator for powering cradle 14 has been described above in conjunction with a common hydraulic jack, the actuator may take other forms without departing from the spirit or scope of the present invention. For instance, the jack may be replaced with a fluid cylinder having its ends pivotally pinned to base plate 114 and to rectangular sleeve 110, thereby eliminating the need for the reaction block 134. Moreover, the jack can be replaced by a mechanical device, such as a ratchet and pawl or by other types of mechanical or electrical devices.

The angular position of the cradle 14 about the axis 22 may be visually indicated by a pointer 164 transversely mounted on the inward end of one or both of the pivot shafts 118, i.e., the end of the pivot shafts extending toward the longitudinal center of the apparatus 10. Angular graduations, preferably numerical, 166 are located on the inward face of the cheek plate 113 to enable the apparatus user to observe the angular position of the pointer 164 and, thus, the rotational travel of the cradle 14. Pointers similar to pointers 164 may also be mounted on the outward ends of one or both the pivot shafts, and angular graduations, similar to graduations 166, may be located on the outward face of the cheek plate 112 to facilitate ascertaining the angular position of the cradle 14 by one other than the user of the apparatus 10, i.e., a physical therapist.

It will be appreciated that the pointer 164, together with the angular graduations 166, enable the user to monitor increases and decreases in the range of motion of the muscles being stretched by use of the present invention. Moreover, the present apparatus may be employed to measure the range of motion of a series of individuals, for instance, for comparison purposes. It will further be appreciated that other types of devices may be utilized to quantify the angular position and travel of the cradle 14 about the pivot axis 22 without departing from the spirit or scope of the present invention.

To utilize the present invention for stretching the muscles of the thigh, hip, and lower back, the individual lies down on the base structure 12 and places the leg to be stretched in the cradle 14 so that the foot is placed within the foot cup 18. It will be appreciated that the foot cup, being nominally biased in a downward, retracted position by the spring-loaded tube assembly 44, automatically adjusts to the length of the user's leg. When lying on the base structure 12, the user's hip joints are placed in alignment with the transverse line 34 extending across padding 28 so that his hip joints are also in alignment with the transverse axis 22 about which the cradle 14 rotates. Knobs 98, controlling the position of rods **92*a* and 92*b* which are connected to the foot cup 18, are tightened to prevent the foot cup 18 from pivoting about the transverse ankle axis 70. The upper leg is strapped to the cradle by strap 54, and the lower leg is restrained by strap assembly 36 or 40**.

Next, the muscles of the lower back, hip and thigh are stretched by manually operating hydraulic jack 20 to rotate the cradle 14 in the counterclockwise direction shown in FIGS. 1 and 2. This is conveniently accomplished by simply pumping the manually graspable handle 138 of the hydraulic jack. It will be appreciated that the user may modulate not only the level but also the rate at which a stretching load is placed on his leg by the speed and the number of times that the jack handle 138 is reciprocated. Furthermore, once a muscle has been stretched to near its maximum, the muscle can be isometrically contracted for a finite time duration and then relaxed, thereby causing the muscle to undergo the proprioceptive neuromuscular facilitation effect which results in a dip in the muscle's contractive response or resistance to stretch so that the muscle can be stretched somewhat further. This further stretching is accomplished by simply operating the jack handle 138. The foregoing is made possible since the cradle 14 does not tend to continue to rotate in the counterclockwise direction when the jack 20 is not being operated so that a continuous stretching load is not placed on the muscle which would prevent the muscle from being sufficiently relaxed to undergo the proprioceptive neuromuscular facilitation effect.

The present invention may be used as thus described to stretch numerous muscles of the lower back, hip and thigh. The primary muscles of this region of the body that are stretched by utilizing apparatus 10 include the hamstring group of muscles of the thigh, i.e., the semimembranous, semitendinous, and biceps femoris. Other primary muscles that are stretched include the gluteus maximus and tensor fascia latae. The muscles that may be secondarily stretched by the present apparatus include the sartorius, rectus femoris, gracilis, adductor longus, adductor brevis and the upper portion of the adductor magnus, which are all muscles of the thigh. Other secondary muscles that are stretched include the erector spinae group and psoas major muscles of the back and the iliacus and pectineus muscles of the hip. In addition, the present invention may be advantageously utilized to stretch the tendons and joint capsules associated with the foregoing muscles.

It will be appreciated that the present invention permits the user to visually quantify his stretching regime by monitoring the location of the pointer 164 relative to the circular graduations 166 located on the inside face of cheek plate 113. The user is able to measure the range of motion of his leg muscles and any changes therein. This enables the user to undertake a safe, progressive stretching program without a substantial risk of injury due to overstretching muscles, tendons or joint capsules. The present invention also allows different sections of the hip, thigh and upper calf muscles to be stretched by adjusting the tightness of the strap 54, thereby permitting the knee to be nominally flexed a desired, controlled amount during stretching exercises.

After the desired stretching duration, the cradle 14 may be conveniently retracted in the clockwise direction shown in FIGS. 1 and 2 by simply rotating knob 150 of the jack 20 into "open" position, thereby to retract the piston rod 130 back into the jack. Moreover, by controlling the open position of the knob 150, the present invention may be used to perform isokinetic exercises.

The present invention also may be utilized to stretch the muscles of the calf, ankle, foot and toes. For instance, knobs 98 of the arm assemblies **16*a* and 16*b* can be loosened to allow the foot cup 18 to pivot about axis 70 as the user stretches and flexes his foot about his ankle joint. This stretching/flexing movement is facilitated by grasping both of the loosened knobs 98 with the hands and pushing up and then pulling down on the knobs in unison to cause the foot cradle 18 to pivot about axis 70. This results in the stretching and flexing of the plantar flexor muscles of the calf, ankle and foot, including the triceps surae, i.e., the gastrocnemius, soleus, plantaris, popliteus, flexor hallicus longus and flexor digitorum longus muscles. The flexor muscles of this region of the body that may be secondarily stretched include the flexor digitorum brevis and the peroneus brevis muscles. The everter and inverter muscles of the calf and foot also may be conveniently everted and inverted by pivoting the foot cup 18 about the longitudinal axis 62. This may be accomplished by alternately pulling down and then pushing up on one of the loosened knobs 98 and simultaneously pushing up and pulling down on the other loosened knob 98 so that the foot cradle 18 is pivoted about axis 62**. By this technique, eversion and inversion of the ankle joint and flexion and extension of the various muscles of the calf and foot can be accomplished, for instance, the peroneus longus and the tibialis posterior muscles. Muscles that may be secondarily flexed and stretched include the peroneus brevis, peroneus tertius and tibialis anterior muscles.

It will be appreciated that by manually manipulating knobs 98, it is possible to simultaneously stretch and flex the muscles of the calf, foot and ankle and also invert and evert the ankle joint. It will be further appreciated that the angular position of the foot cup 18 about axis 70 and/or 62 may be visually indicated by any appropriate method, for example, through the use of a pointer similar to pointer 164 discussed above and angular graduations similar to graduations 166 also discussed above.

Figure 4:
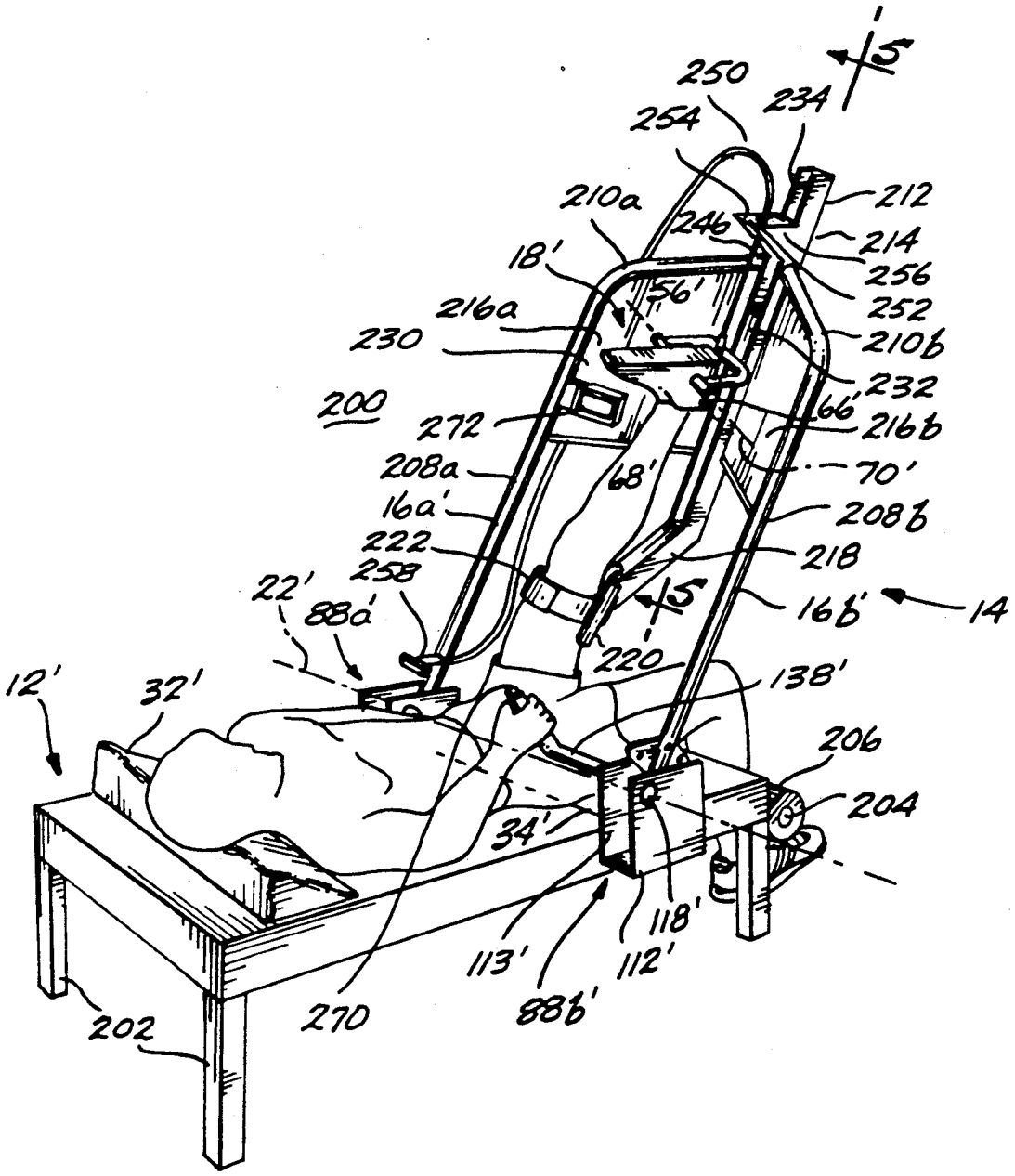
FIG. 4 is an isometric view of an alternative preferred embodiment of the present invention.
Figure 5:
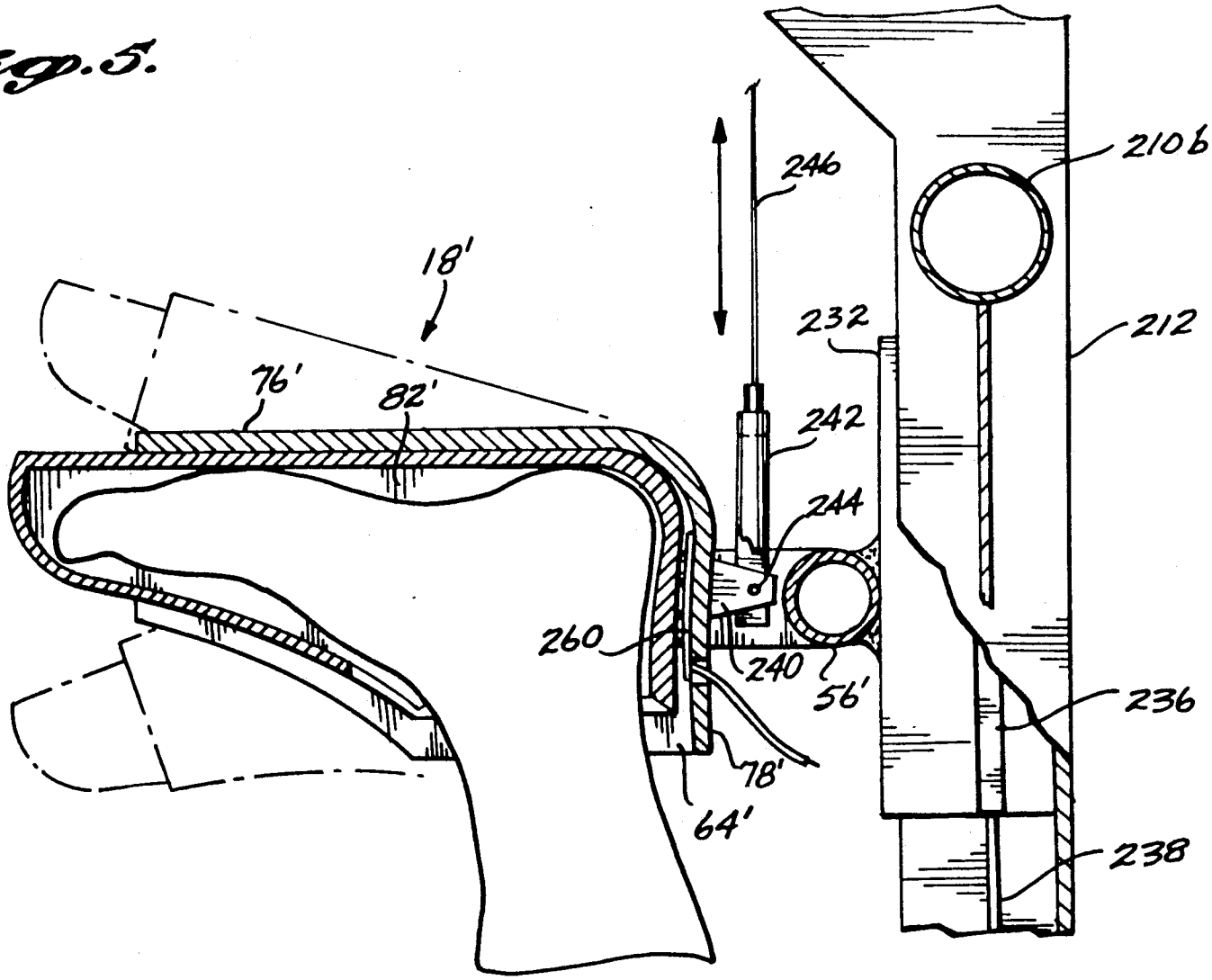
FIG. 5 is an enlarged, fragmentary, cross-sectional view of a portion of the stretching apparatus illustrated in FIG. 4 taken substantially along lines 5—5 thereof; and, FIG. 6 is a schematic view of the stretching apparatus shown in FIGS. 5 and 6 specifically illustrating the manner in which the stretching load applied to the body limb is quantified.
Figure 6:
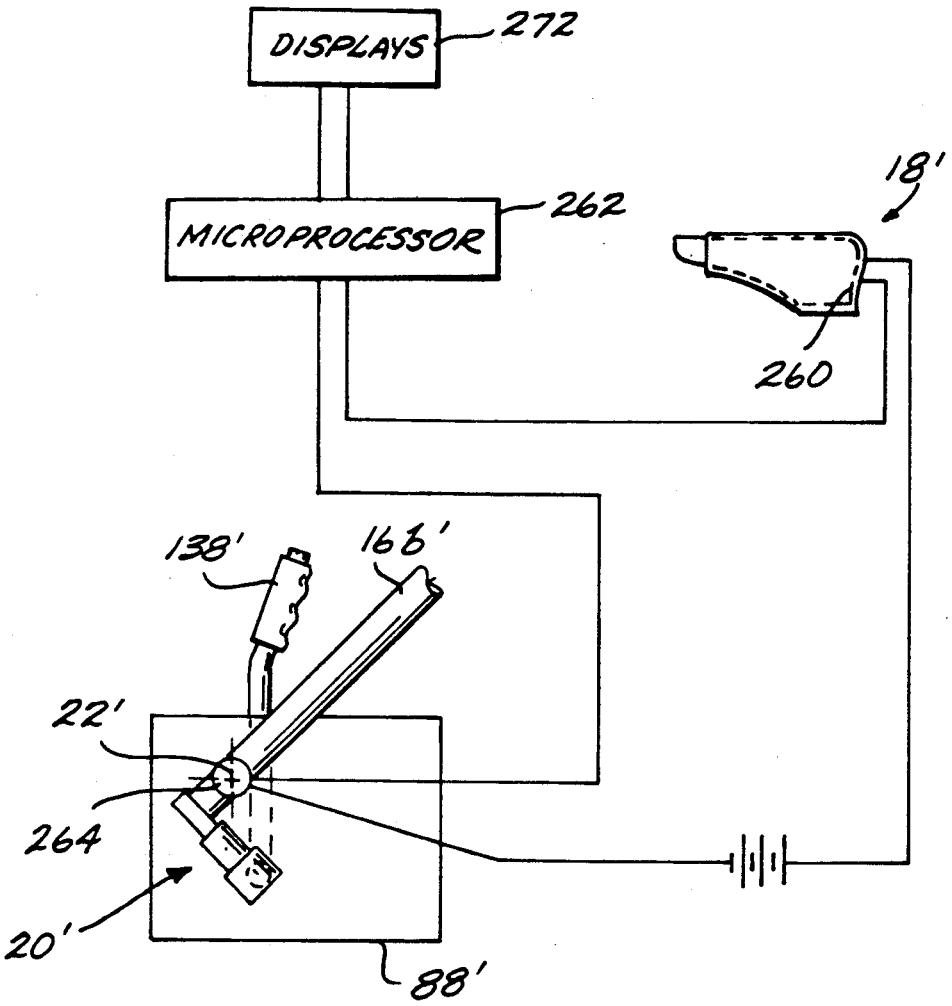

A further preferred embodiment of the present invention is illustrated in FIGS. 4, 5 and 6, wherein the components of a stretching apparatus 200 which correspond to the components of the stretching apparatus 10, as shown in FIGS. 1-3, are referred to by the same part numbers, but with the addition of a prime '''' designation. Also, the components and aspects of apparatus 200 which are the same as or similar to the components of and aspects of apparatus 10 will not necessarily be redescribed in detail to avoid unnecessary repetition.

The apparatus 200 includes a base structure 12' for supporting an individual in supine position, providing support for the head, torso, and upper section of the stationary leg of the individual. The leg being stretched is disposed within a cradle 14'. The cradle 14' includes a foot cup 18' for receiving and supporting the rear and side portions of the individual's foot. A power device in the form of a hydraulic actuator 20' is manually operated by the individual to pivot the cradle 14' about an axis 22' extending transversely across the individual's body at a location substantially aligned with the hip joints of the individual.

As in the description of the apparatus 10, shown in FIGS. 1-3, in the following further description of the apparatus 200, illustrated in FIGS. 4, 5 and 6, the term "forward" shall refer to the direction toward the individual's head, i.e., left-hand direction shown in FIGS. 4 and 5. Conversely, the "rearward" direction shall refer to the right-hand direction shown in FIGS. 4 and 5. Also, the "upward" direction shall refer to the direction toward the foot cup 18', whereas the "downward" direction shall refer to the direction toward the base structure 12'. Further, the "inward" direction shall refer to the direction toward the longitudinal center of the apparatus, whereas the "outward" direction shall refer to the direction toward the longitudinal outside edges of the base structure 12'.

Base structure 12', as shown in FIGS. 4 and 5, may be constructed substantially the same as base structure 12 shown in FIGS. 1 and 2, but with the addition of legs 202 extending downwardly from each of the corners of the base structure to support the base structure above the level of the floor. Preferably, the top of the base structure is at an elevation whereby for an average height person, the stationary foot of such person can rest on the floor. Ideally, the base structure 12' is constructed of a width which is sufficient to enable the user to position a desired leg in the cradle 14', with the user's torso positioned between the cradle and the adjacent side of the base structure. Preferably, a positioning line 34' extends across the base structure at a location corresponding to the hip pivot axis 22' for use by the individual to properly position his body so that his hip joints are positioned in alignment with the pivot axis 22'.

Ideally, a restraining bar 204 extends across the rearward end of the base structure at a location spaced sufficiently rearwardly of the base structure to enable the stationary leg to be placed between the end of the base structure and the restraining bar. The restraining bar may be fixedly attached to the base structure by any convenient means, not shown. Ideally, a resilient, cylindrical pad 206 is engaged over the restraining bar so that the front (shin portion) of the stationary leg of the individual may be pushed against the pad without causing significant discomfort thereto. Ideally, the pad 206 is constructed from a durable, resilient material such as foamed vinyl. Preferably, but not essentially, a padded pillow 32' is positioned at the head of the base structure for the comfort of the user. As with pillow 32, the pillow 32' can be permanently mounted on the base structure or can be movable to facilitate replacement and to accommodate users of different body sizes.

As most clearly illustrated in FIG. 4, the leg cradle 14' is composed of a pair of longitudinally extending, formed arms **16*a*' and 16*b*'. The arms 16*a*' and 16*b*' include lower sections 208*a* and 208*b* having their bottom ends pivotally mounted to the side portions of the base structure 12' by mounting structures 88*a*' and 88*b*', respectively. The mounting structures each include an outer cheek plate 112' and an inner cheek plate 113' for closely receiving the lower ends of the leg sections 208*a* and 208*b* therebetween. A pivot shaft 118', aligned with axis 22', extends transversely between the cheek plates 112 and 113 to extend through aligned openings formed in the cheek plates and also through transverse openings formed in the arm lower sections 208*a* and 208*b* thereby to pivotally mount the arm lower sections to the mounting structures 88*a*' and 88*b*' in a manner similar to apparatus 10 shown in FIGS. 1-3**.

The arms **16*a*' and 16*b*' also include upper sections 210*a* and 210*b* that extend inwardly and rearwardly (as seen in FIG. 4) from the distal ends of the lower arm sections 208*a* and 208*b* to intersect with the opposite side portions of an elongated, U-shaped slideway structure 212. The slideway structure 212 includes an elongate, straight upper section 214 extending parallel to the lower sections 208*a* and 208*b* of the arm members 16*a*' and 16*b*'. The slideway upper section 214 is positioned at a location corresponding to the location of the telescoping rear tube assembly 44 shown in FIGS. 1 and 2. The slideway upper section 214 is also interconnected with the arms 16*a*' and 16*b*' by a plate 216*a* that is disposed coplanar with the plane defined by the lower and upper sections 208*a* and 210*a* of leg 16*a*' as well as by a plate 214*b* disposed coplanar to the plane defined by the lower and upper arm sections 208*b* and 210*b* of leg 16*b*'. The plates 214*a* and 214*b* extend inwardly to intersect with the sidewalls of the slideway upper section 214. It is to be understood that the plates 216*a* and 216*b*** may be replaced by any other appropriate structural members, such as tubes or bars.

Ideally the arms **16*a*' and 16*b*' are constructed from tubular material for convenience of manufacture and sufficient structural integrity without undue weight. However, it is to be understood that the arms 16*a*' and 16*b*'** may be composed of other types of structure members without departing from the spirit or scope of the present invention.

The slideway structure 212 includes a lower section 218 extending downwardly and diagonally forwardly (as shown in FIG. 4) from the upper section 214 to support at its lower end an arcuate pad 220 for bearing against the thigh of the user's leg being stretched. Preferably, a strap assembly 222, shown wrapped around the thigh of the user, is engaged with the pad 220 to secure the user's thigh to the pad. The ends of the strap assembly 222 may be detachably fastened together by any convenient means, such as by utilizing Velcro ® or buckle or other type of clasp, as is well known in the art.

The foot cup 18' incudes an outer shell 230 pivotally mounted on a tubular yoke 56' which in turn is carried by a carriage 232 slidably disposed within the interior of the slideway structure 212. The forward ends of the yoke 56' (as seen in FIG. 4) are pivotally attached to the sidewalls of the foot cup outer shell 230 by pivots shafts 66' extending through central openings formed in transverse bosses 68' positioned transversely at the forward ends of the yoke 56'. The inward ends of the pivot shafts 66' are attached to the sidewalls of the foot cup by any convenient method. It will be appreciated that by this construction, the foot cup 18' may be pivoted about a transverse axis 70' defined by the pivot shafts 66', which, ideally, coincides with the ankle of the user.

As shown in FIG. 4, the central portion of the yoke 56' is secured to the carriage 232 by any convenient method, such as through weldments. The carriage 232 is closely receivable within a slideway 234 defined by the slideway upper section 214. The carriage may be constructed from tubular material and may be coated on its exterior to form antifriction surfaces to permit the slide to freely move within the slideway 234. Ideally, the carriage 232 is retained against disengagement from the slideway 234 in the direction transversely to the length of the slide for permitting the carriage to freely slide along the slideway. This can be accomplished by any convenient means, such as by forming a longitudinal groove 236 in the side walls of the carriage for closely receiving an aligned rib 238 therein extending inwardly along the length of the slide walls of the slideway upper section 214, FIG. 5.

Ideally, the foot cup 18' is constructed similarly to foot cup 18 illustrated in FIGS. 1 and 2. In this regard, the outer shell 230 of the foot cup 18' includes a substantially flat sole plate portion 76', a curved back wall 78' for overlapping and supporting the back of the foot of the user, and sidewalls 64' forming a continuation of the back wall to extend forwardly from the back wall to past the location of the ankle and then tapering toward the sole plate portion 76' to intersect with the front of the sole plate portion. Ideally, for economy of production, the outer shell 230 is molded as a singular unit from any appropriate material, such as a high-strength plastic.

As with foot cup 18, ideally, foot cup 18' includes an inner liner 82' disposed within the outer shell 230 to provide comfort for the foot of the user and traction between the foot and the foot cup. It is to be understood that the shape and thickness of the liner may be varied to accommodate feet of different sizes and also to position feet within the foot cup so that the ankle of the user is substantially in alignment with axis 70'. To this end, the liner is movable relative to and may be readily removable from the outer shell 230. The liner 82' may be comprised of any appropriate material, such as open- or closed-cell foam. In addition, various sections of linear may be formed in different hardnesses, depending upon various factors, such as the level of load applied to the section of the liner by the users foot.

As with foot cup 18, discussed above, the foot cup 18' can be formed with simply the sole plate portion 76' and the back wall 78'. In this instance, the pivot pins 66' may be attached to the side edge portions of the sole plate portion rather than to the sidewalls.

The angular position of the foot cup 18' relative to the transverse pivot axis 70' may be conveniently and manually adjusted so that different muscles of the calf, ankle, and foot are stretched during the use of the present invention. To this end, a bracket 240 extends rearwardly from the rear wall 78' of the foot cup outer shell 230. A clevis 242 is pinned to the bracket 240 by a cross pin 244 extending through aligned holes formed in the tines of the clevis and also through a clearance hole formed in the bracket 240. The opposite end of the clevis 242 is attached to the inner cable 246 of a push-pull cable assembly 248 of a standard construction. The adjacent end of the outer sheath 250 of the cable assembly 248 bears against a cross wall 252 of a bracket 254 located at the upper end of the slideway upper section 214, (as shown in FIG. 4). Bracket 254 also includes triangular sidewalls 256 that are coplanar with the sidewalls of the slideway structure 212. The inner cable 246 of the cable assembly 248 extends through a clearance hole formed in the bracket cross wall 252.

At its opposite end, the cable assembly 248 extends through cross holes formed in the lower portion of arm lower section **208*a*. A manually graspable T-shaped twist handle 258 is secured to the adjacent end of the cable 246. Ideally, this end of the cable assembly 248 includes a standard locking mechanism, not shown, by whereby twisting the T handle in one direction, the cable 246 may be unlocked relative to the sheath 250, pushed or pulled through the sheath 250 and then be subsequently rotated back in the opposite direction thereby to again lock the cable 246 relative to the cable sheath 250 to prevent relative longitudinal movement therebetween. As a result, the angular position of the foot cup 18' is maintained relative to the transverse axis 70', as desired. Such cable assembly locking mechanisms are standard articles of commerce. It will be appreciated that by positioning the T handle 258 at a lower portion of the arm section 208*a***, the handle may be conveniently grasped by the user when in supine position.

An electronic sensor 260 is utilized to measure the force exerted by the user's leg on the cradle 14', which information may be utilized to in turn calculate the stretching load being applied to the leg with the apparatus of the present invention, as discussed more fully below. The sensor 260 may be in the form of a beam-type strain gauge interposed between the foot cup inner shell 82' and the rear wall 78' of the foot cup outer shell 230, as illustrated in FIG. 5 and also schematically in FIG. 6. Beam-type strain gauges, such as sensor 260, are standard articles of commerce. An example of one such type of strain gauge is Model No. LCL-040, available through Omega Engineering, Inc. of Stamford, Conn. The signal from the sensor 260 is transmitted to a microprocessor 262, see FIG. 6.

A potentiometer is utilized to measure the angle of the cradle 14' about axis 22' to produce an electrical signal related thereto. This signal is also transmitted to the microprocessor. The potentiometer 264 may be of a "pot" type mounted on or within the mounting structure **88*a'* in alignment with transverse axis 22'. The pivot shaft 118' associated with the mounting structure 88*a'* may be adapted to rotate with the cradle arm 16*a'* thereby to change to the electrical signal produced by the potentiometer 264 as the angle of inclination of the cradle 14' varies. Potentiometers, such as potentiometer 264**, are standard articles of commerce.

The cradle 14' is rotated about the transverse axis 22' ideally with a hydraulic linear actuator 20', similar to the actuator 20 discussed above. The hydraulic actuator 20' may include a rod end which is pinned to the lower end of the cradle arm lower section **208*b* and a cylinder end which is pinned to mounting structure 88*b'*. The linear actuator 20 may include a pumping or jacking assembly which is manually operable through a formed handle 138' extending upwardly and transversely from the mounting structure 88*b'* to be conveniently graspable by the user while in supine position. The linear actuator 20' may include a pressure release valve operable through a pushbutton 270 mounted on the end of the handle 138' adjacent the hand of a user. Linear actuators, such as linear actuator 20', are standard articles of commerce. It will be appreciated that through the foregoing construction of the linear actuator, the actuator may be operated to raise and lower the cradle 14' while the user is in relaxed, supine position on the base 12' of the apparatus 200**.

To utilize the present invention for stretching the muscles of the thigh, hip, and lower back, the individual lies on the base structure 12' and places the leg to be stretched in the cradle 14' so the foot is placed within the foot cup 18'. It will be appreciated that the foot cup may be nominally biased in the direction toward the base structure 12', for instance by spring, not shown, that applies a load on the carriage 232 in that direction, thereby to automatically adjust to the length of the user's leg. When lying on the base structure 12', the user's hip joints are placed in alignment with the transverse line 34' extending across the base structure 12' so that the user's hips are in substantial alignment with the transverse axis 22' about which the cradle 14' rotates. The angle of the foot cup 18' is adjusted by use of the twist knob 258, as discussed above. The thigh of the user's leg is strapped to pad 220 by the strap 222. The other leg of the user may be positioned so that the shin bears against the pad 206 of the restraining bar 204.

Next, the muscles of the lower back, hip, and thigh are stretched by manually operating the linear actuator 20' by pumping the handle 38', thereby to cause the cradle 14' to rotate in the counterclockwise direction shown in FIG. 4. However, before doing so, when the user's relaxed leg is placed in the cradle 14', the pressure sensor 260 senses the downward force that the user's leg imposes on the foot cup 18' and thus weight of the user's leg, and produces an electrical signal related thereto which is transmitted to the microprocessor 262 for recording. This weight may be shown on a display 272 mounted on the carriage arm **16*a'*** so as to always be in a vertical orientation and thus viewable by the user.

The digital readout of the display 272 may then be calibrated to "zero" since when the leg is in a horizontal position, little, if any, stretching force is being applied to the leg. As the user's leg is raised by the rotation of the cradle, the pressure exerted on the sensor 260 by the weight of the user's leg itself diminishes trigonometrically as the angle of the cradle increases. The angle of the cradle is measured by the potentiometer 264, which produces an electrical signal related to the angle of the cradle and transmits such electrical signal to the microprocessor 262. As the cradle is raised, the pressure exerted on the sensor 260 due to the tension of the muscles, tendons, joint capsules, and skin of the stretched leg increases while the pressure exerted on the sensor by the weight of the user's leg diminishes. The microprocessor calculates the diminishing effect of the load on the sensor 260 caused simply by the weight of the user's leg and calculates the reaction pressure being applied to the foot cup due to the stretched muscles, tendons, joint capsules, and skin of the leg. This tension load may be displayed on the display 272 in pounds or kilograms, as selected by the user, to provide a quantification of the "stretch" being applied to the user's leg. The angle of the cradle 14' may also be displayed to provide another indication of the quantification of the stretching activity which is occurring.

As with apparatus 10 described above, the apparatus 200 may be utilized to maintain the leg near its maximum stretched condition so that the leg muscles can be isometrically contracted for a finite time duration and then relaxed, thereby causing the muscles to undergo the proprioceptive facilitation phenomenon, which results in a dip in the muscles' contractive response or resistance to stretch so that the muscle can be stretched somewhat further.

As with apparatus 10 described above, the apparatus 200 can be employed to stretch numerous of the muscles of the lower back, hip and thigh. Moreover, by quantifying the user's stretching regime, overstretching of the leg is avoided, while permitting the user to undertake and safe and progressive stretching program. Also, different sections of the leg muscles may be stretched by adjusting the tightness of the strap 222 and also the angle of the foot cup 18'. Further, the present invention is not limited to the stretching of the user's leg, but may be employed to stretch other body components, such as the back, neck, and arms of the user. Of course, appropriate modifications of the size and location of some of the components of the present invention described above may be necessary when adapting the present invention for use with other body limbs of the user.

As will be apparent to those skilled in the art to which the invention is addressed, the present invention may be embodied in forms other than those specifically disclosed above without departing from the spirit or essential characteristics of the invention. The particular embodiments of the apparatus 10 and 200, described above, are therefore to be considered in all respects as being merely illustrative of forms of apparatus capable of carrying out the present invention. The scope of the present invention is as set forth in the appended claims, rather than being limited to the foregoing description.

The embodiments of the invention in which an exclusive property or privilege is claimed are defined as follows:

1. A leg stretching apparatus, comprising:

a base structure for supporting an exerciser in supine position;

a leg cradle for receiving a first leg of the exerciser;

means included on said leg cradle for contacting against at least one desired location along the length of the first leg or the foot of the first leg;

means for mounting the leg cradle on the base structure to pivot the leg cradle about an axis extending transversely to the exerciser and wherein the axis is displaced above the base structure so as to be substantially aligned with the pivot axis of the hip joints of the exerciser;

means for pivoting the cradle about the hip pivot axis of the cradle to flex the hip joint of the first leg and thereby stretch the muscles, tendons, joint capsules and skin of the first leg;

means for maintaining the cradle at selected angular positions about the pivot axis of the cradle without tending to impart a further stretching movement on the muscles, tendons, joint capsules and skin of the first leg and;

means included on said leg cradle, cooperating with said means for contacting the first leg, for limiting flexion of the knee joint to no more than a selected degree during pivoting of the cradle about the hip pivot axis of the cradle and maintenance of the cradle in a selected angular position.

2. The stretching apparatus according to claim 1, wherein the means for contacting the first leg includes:

foot-receiving means selected from the group consisting of: a foot cup for receiving and supporting at least the hell portion of the foot of the first leg and a foot plate for bearing against the sole of the foot of the first leg; and thigh fastening means for securing the thigh of the first leg to the leg cradle.

3. The stretching apparatus according to claim 2, wherein said cradle includes means for mounting the foot-receiving means on the cradle to pivot the foot-receiving means about an axis transverse to the foot and closely corresponding with the ankle joint of the first leg.

4. The stretching apparatus according to claim 3, wherein the cradle further comprises means for maintaining the foot-receiving means at a desired angular position relative to the cradle about the transverse ankle axis of the foot-receiving means.

5. The stretching apparatus according to claim 4, wherein the means for mounting the foot-receiving means on the cradle to pivot the foot-receiving means about the transverse ankle axis of the foot and the means for maintaining the foot-receiving means at a desired angular position about the transvers ankle axis are manually operable by the hands of the exerciser while the first leg of the exerciser is received within the cradle.

6. The stretching apparatus according to claim 1, wherein said cradle further includes means for mounting the foot-receiving means on the cradle to permit the foot-receiving means to pivot about an axis extending longitudinally of the exerciser's foot.

7. The stretching apparatus according to claim 6, further comprising means for locking the contacting means in a desired angular orientation relative to the cradle about the longitudinal pivot axis of the foot-receiving means.

8. The stretching apparatus according to claim 1, wherein the leg cradle includes means for adjusting the distance between the hip pivot axis of the cradle and the contacting means of the cradle, and maintaining the contacting means of the cradle at such distance during pivoting of the cradle about the hip pivot axis.

9. The stretching apparatus according to claim 8, wherein the means for adjusting the distance between the hip pivot axis of the cradle and the contacting means of the cradle includes a carriage on which the contacting means is mounted and a slideway extending longitudinally of the cradle for slidably receiving the carriage.

10. The stretching apparatus according to claim 1, wherein:

the leg cradle comprises at least one arm extending along the cradle to the hip pivot axis of the cradle; and, the means for providing the leg cradle actuator means operating on the cradle arm to pivot the cradle about the hip pivot of the cradle.

11. The streching apparatus according to claim 10, wherein the actuator means is operable by the exerciser while the leg of the excerciser is received within the cradle.

12. The stretching apparatus according to claim 11, wherein the actuator means includes means for maintaining the cradle at a desired angular orientation about the hip pivot axis of the cradle.

13. The stretching apparatus according to claim 1, further comprising means for indicating to the exerciser the angular position of the cradle about the hip pivot axis of the cradle.

14. The stretching apparatus according to claim 1, further comprising means for quantifying the level of tension being imposed on the limb by the cradle.

15. A stretching apparatus, comprising:

a cradle having a section for receiving a first limb of a user's body, the cradle including:

first and second longitudinally extending, laterally spaced apart, cradle support members having first ends pivotally mounted about the transverse pivot axis of the hip;

a medial member assembly fixed to and extending longitudinally relative to the first and second cradle support members;

a foot cup having portions for receiving the rear and side portions of the user's foot and supporting the rear portion of the user's foot;

means for mounting the foot cup on the medial member assembly to pivot the foot cup about a first transverse axis closely coinciding with the pivot axis of the user's ankle; and means for pivoting the cradle about an axis substantially aligned with the pivot axis of the first limb, thereby to stretch the muscles, tendons, joint capsules and skin associated with the first limb to a desired degree and then maintaining the cradle at such angular position about the pivot axis of the cradle coinciding with the desired angular position of the first limb about the pivot axis of the first limb, thereby enabling the muscles associated with the first limb to be maximally contracted and then relaxed, causing a reduction in the stretch reflex of the muscle.

16. The stretching apparatus according to claim 15, wherein the cradle means further comprises means for adjusting the angular position of the foot cup relative to the first transverse axis of the foot cup.

17. A stretching apparatus comprising:

a cradle having a section for receiving a first limb of a user's body;

means for pivoting the cradle about an axis corresponding to the pivot axis of the first limb to a selected angular position, thereby to stretch the muscles, tendons, joint capsules and skin associated with the first limb;

means for maintaining the cradle at such selected angular position about the pivot axis of the cradle, thereby enabling the muscles associated with the first limb to be maximally contracted and then relaxed, causing a reduction in the stretch reflex of the associated muscles; and control means coupled with the pivot means pivoting the cradle to an extent based on the extent of stretch of the first limb, wherein the control means includes means for measuring the total force exerted on the cradle by the user's limb as well as a portion of such total force due to the weight of the user's limb being carried by the cradle.

18. The stretching apparatus according to claim 17, wherein the measuring means includes means for measuring the angular position of the cradle about the pivot axis of the cradle.

19. A leg stretching apparatus, comprising:

a base structure for supporting an exerciser in supine position;

a leg cradle for receiving a first leg of the exerciser and having means for contacting the first leg at a desired location below the knee joint and at or above the foot;

adjustable strap means mounted on the leg cradle for encircling the thigh of the first leg to control the degree of flexion of the knee joint of the first leg;

means for mounting the leg cradle on the base structure to pivot the leg cradle about an axis extending transversely to the user and wherein the axis is displaced above the base structure so as to be substantially aligned with the pivot axis of the hip joints of the exerciser; and means for pivoting the cradle about the pivot axis of the cradle to flex the hip joint of the first leg and thereby stretch the first leg; and means for maintaining the cradle at selected angular positions about the pivot axis of the cradle without tending to inpart a further stretching movement on the first leg, the strap means for contacting the first leg to limit flexion of the knee joint to no more than a selected degree during pivoting of the cradle and maintenance of the cradle at a selected angular position.

* * * * *

UNITED STATES PATENT AND TRADEMARK OFFICE

CERTIFICATE OF CORRECTION

PATENT NO. : 5,122,106

DATED : June 16, 1992

INVENTOR(S) : D.F. Atwood et al.

It is certified that error appears in the above-identified patent and that said Letters Patent is hereby corrected as shown below:

| | |
|---|---|
| Column 10, line 57 | after "muscles." begin a new paragraph with "The everter" |
| Column 13, line 6 | "incudes" should read --includes-- |
| Column 13, line 62 | "linear" should read --liner-- |
| Column 14, lines 28 & 29 | "by whereby" should read --whereby by-- |
| Column 17, line 16 (Claim 2, line 5) | "hell" should read --heel-- |
| Column 17, line 36 (Claim 5, line 6) | "transvers" should read --transverse-- |
| Column 17, line 66 (Claim 10, line 6) | "providing" should read --pivoting-- |
| Column 18, line 3 (Claim 11, line 3) | "excerciser" should read --exerciser-- |
| Column 18, line 15 (Claim 14, line 3) | "limb" should read --first limb-- |
| Column 20, line 12 (Claim 19, line 22) | "inpart" should read --impart-- |
| Column 20, line 13 (Claim 19, line 23) | after "means" insert --cooperating with the means-- |

Signed and Sealed this

Fifth Day of October, 1993

Bruce Lehman

*Attest:*

BRUCE LEHMAN

*Attesting Officer*

*Commissioner of Patents and Trademarks*